US008172668B2

(12) United States Patent
Gomez

(10) Patent No.: US 8,172,668 B2
(45) Date of Patent: May 8, 2012

(54) WAGERING GAME HAVING THEMATIC STATE BASED ON SECONDARY EVENT

(75) Inventor: Benjamin T. Gomez, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 430 days.

(21) Appl. No.: 12/424,242

(22) Filed: Apr. 15, 2009

(65) Prior Publication Data

US 2010/0267445 A1 Oct. 21, 2010

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 4,752,068 | A | 6/1988 | Endo | |
| 5,609,525 | A | 3/1997 | Ohno et al. | |
| 6,165,071 | A | 12/2000 | Weiss | |
| 6,254,483 | B1 | 7/2001 | Acres | |
| 6,485,367 | B1 | 11/2002 | Joshi | |
| 6,758,757 | B2 | 7/2004 | Luciano, Jr. et al. | |
| 6,780,111 | B2 | 8/2004 | Cannon et al. | |
| 6,800,027 | B2 | 10/2004 | Giobbi et al. | |
| 6,811,486 | B1 | 11/2004 | Luciano, Jr. | |
| 6,843,723 | B2 | 1/2005 | Joshi | |
| 6,923,721 | B2 | 8/2005 | Luciano et al. | |
| 6,939,226 | B1 | 9/2005 | Joshi | |
| 6,960,136 | B2 | 11/2005 | Joshi et al. | |
| 6,991,543 | B2 | 1/2006 | Joshi | |
| 2002/0077174 | A1 | 6/2002 | Luciano et al. | |
| 2003/0083120 | A1* | 5/2003 | DeWall et al. | 463/16 |
| 2004/0142742 | A1 | 7/2004 | Schneider et al. | |
| 2005/0159207 | A1 | 7/2005 | Thomas | |
| 2006/0068893 | A1 | 3/2006 | Jaffe et al. | |
| 2006/0079316 | A1 | 4/2006 | Flemming et al. | |
| 2006/0079317 | A1 | 4/2006 | Flemming et al. | |
| 2006/0084495 | A1 | 4/2006 | Jaffe et al. | |
| 2006/0089194 | A1 | 4/2006 | Joshi et al. | |
| 2008/0194315 | A1* | 8/2008 | Seelig et al. | 463/20 |
| 2009/0264180 | A1* | 10/2009 | Roukis et al. | 463/20 |
| 2010/0255900 | A1 | 10/2010 | Ansari et al. | |

FOREIGN PATENT DOCUMENTS

| | | |
|---|---|---|
| WO | WO2005082480 | 9/2005 |
| WO | WO2006002241 | 1/2006 |
| WO | WO2006004831 | 1/2006 |
| WO | WO2006004832 | 1/2006 |
| WO | WO2006005073 | 1/2006 |

(Continued)

*Primary Examiner* — William D Coleman
(74) *Attorney, Agent, or Firm* — Nixon Peabody LLP

(57) ABSTRACT

A gaming system includes one or more displays and a wager input device for receiving a wager to play a wagering game having a plurality of possible thematic states. The gaming system includes a controller coupled to the one or more displays and the wager input device that is operative to cause at least one of the displays to display a basic portion of the wagering game in a first thematic state of the plurality of possible thematic states and trigger a secondary event of the wagering game. The controller is operative to cause at least one of the displays to display the secondary event of the wagering game in a second thematic state of the plurality of possible thematic states and, at a conclusion of the secondary event, cause at least one of the displays to display the basic portion of the wagering game in the second thematic state.

22 Claims, 17 Drawing Sheets

FOREIGN PATENT DOCUMENTS

| | | |
|---|---|---|
| WO | WO2006017036 | 2/2006 |
| WO | WO2006017067 | 2/2006 |
| WO | WO2006017068 | 2/2006 |
| WO | WO2006020811 | 2/2006 |
| WO | WO2006026250 | 3/2006 |
| WO | WO2006044252 | 4/2006 |

* cited by examiner

WAGERING GAME HAVING THEMATIC STATE BASED ON SECONDARY EVENT

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus and methods for playing wagering games, and more particularly, to wagering games having a thematic state based on a secondary event.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary event" or "bonus game" that may be played in conjunction with a "basic" game. The secondary event may comprise any type of game, either similar to or completely different from the basic game, which is entered upon the occurrence of a selected event or outcome in the basic game. Generally, secondary events provide a greater expectation of winning than the basic game and may also be accompanied with more attractive or unusual video displays and/or audio. Secondary events may additionally award players with "progressive jackpot" awards that are funded, at least in part, by a percentage of coin-in from the gaming machine or a plurality of participating gaming machines. Because the secondary event concept offers tremendous advantages in player appeal and excitement relative to other known games, and because such games are attractive to both players and operators, there is a continuing need to develop gaming machines with new types and uses of secondary events to satisfy the demands of players and operators.

SUMMARY OF THE INVENTION

According to one aspect of the present invention, a gaming system includes one or more displays. The gaming system further includes a wager input device for receiving a wager to play a wagering game having a plurality of possible thematic states. The gaming system further includes a controller coupled to the one or more displays and the wager input device. The controller is operative to cause at least one of the displays to display a basic portion of the wagering game in a first thematic state of the plurality of possible thematic states. The controller is also operative to trigger a secondary event of the wagering game. The controller is also operative to cause at least one of the displays to display the secondary event of the wagering game in a second thematic state of the plurality of possible thematic states. The controller is also operative to, at a conclusion of the secondary event, cause at least one of the displays to display the basic portion of the wagering game in the second thematic state.

According to another aspect of the invention, a method of conducting a wagering game for a human player, the wagering game including a game sequence in which a player provides an input and a wagering game outcome is determined, the wagering game including a basic game, a secondary event, and a plurality of possible thematic states, includes using an interface device to accept the player input, and transforming the player input to electronic data signals indicative of a wager to play the wagering game. The method further includes using one or more processors to interpret the wager from the data signals and to cause the recording of a digital representation of the wager in one or more storage devices. The method further includes using at least one of the processors to cause one or more display devices to display the basic game in a first thematic state of the plurality of possible thematic states. The method further includes using at least one of the processors to initiate the secondary event in response to a triggering event in the basic game. The method further includes using at least one of the processors to cause at least one of the display devices to display the secondary event in a second thematic state of the plurality of possible thematic states. The method further includes using at least one of the processors to, upon concluding the secondary event, cause at least one of the display devices to display the basic game in the second thematic state.

According to another aspect of the invention, a method of conducting a wagering game for a human player, the wagering game including a game sequence in which a player makes a wager and a wagering game outcome is determined, the wagering game including a plurality of possible thematic states, includes conducting the wagering game using a gaming apparatus to receive inputs from the player and to generate wagering game outcomes that are communicated to the player. The gaming apparatus includes a user interface device configured to receive an input from the player. The gaming apparatus also includes one or more display devices configured to display information or graphics to be viewed by the player. The gaming apparatus also includes one or more storage devices. The gaming apparatus also includes one or more processors configured to execute computer instructions relating to the wagering game. The gaming apparatus also includes accepting, at the user interface device, a player input and transforming the player input into electronic data signals indicative of a wager to play the wagering game. The method further includes using at least one of the gaming apparatus processors to interpret the wager from the data signals and to, at least in part, cause the recording of a digital representation of the wager in at least one of the gaming apparatus storage devices. The method further includes using at least one of the gaming apparatus processors to cause at least one of the display devices to display a basic portion of the wagering game in a first thematic state of the plurality of possible thematic states. The method further includes using at least one of the gaming apparatus processors to cause at least one of the display devices to display a secondary event in a second thematic state of the plurality of possible thematic states. The method further includes using at least one of the gaming apparatus processors to, upon concluding the secondary event, cause at least one of the display devices to display the basic portion of the wagering game in the second thematic state.

According to yet another aspect of the invention, a computer readable storage medium is encoded with instructions for directing a gaming system to perform the above method.

Additional aspects of the invention will be apparent to those of ordinary skill in the art in view of the detailed description of various embodiments, which is made with reference to the drawings, a brief description of which is provided below.

Figure 1A:
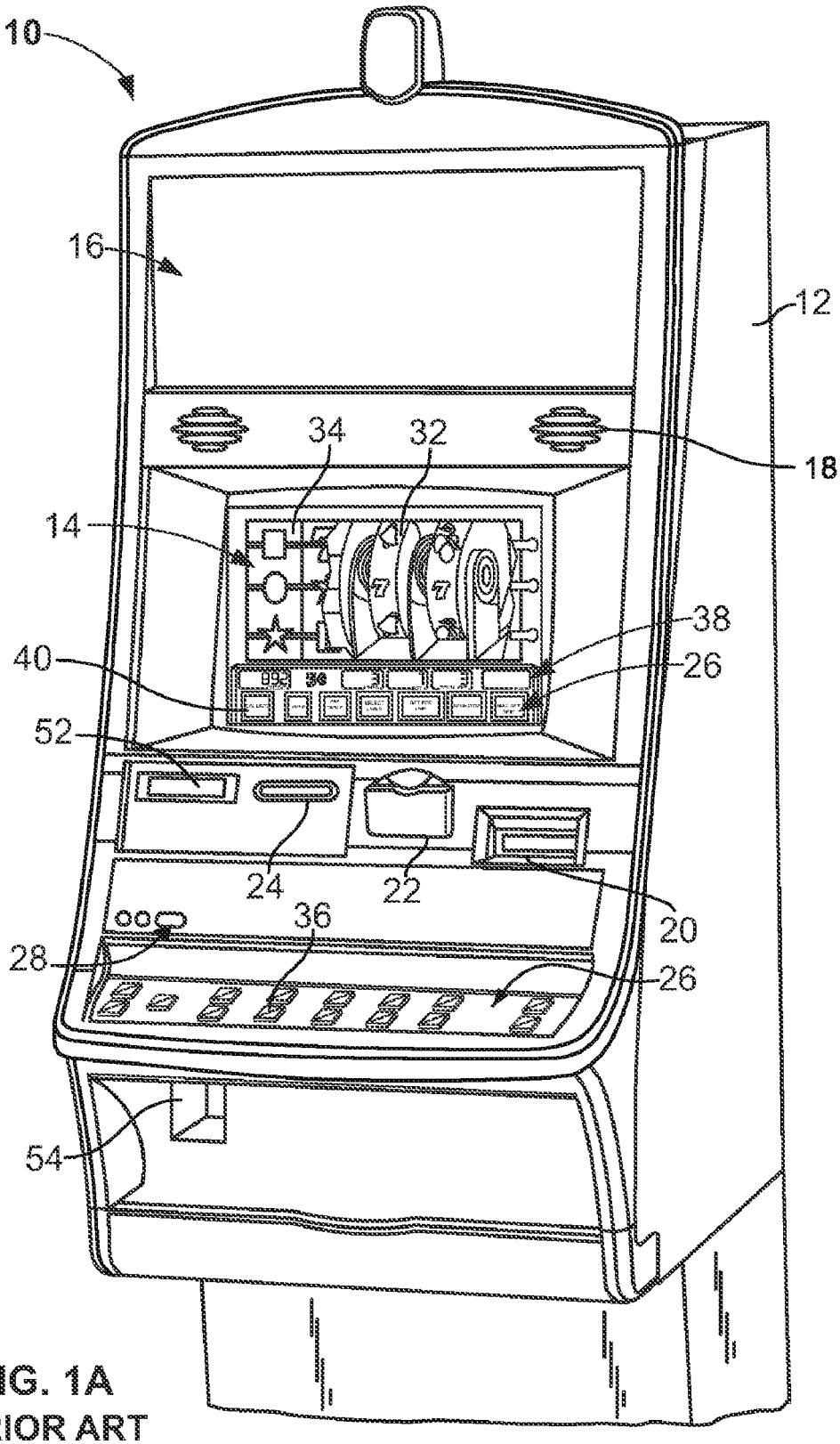
FIG. 1A PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
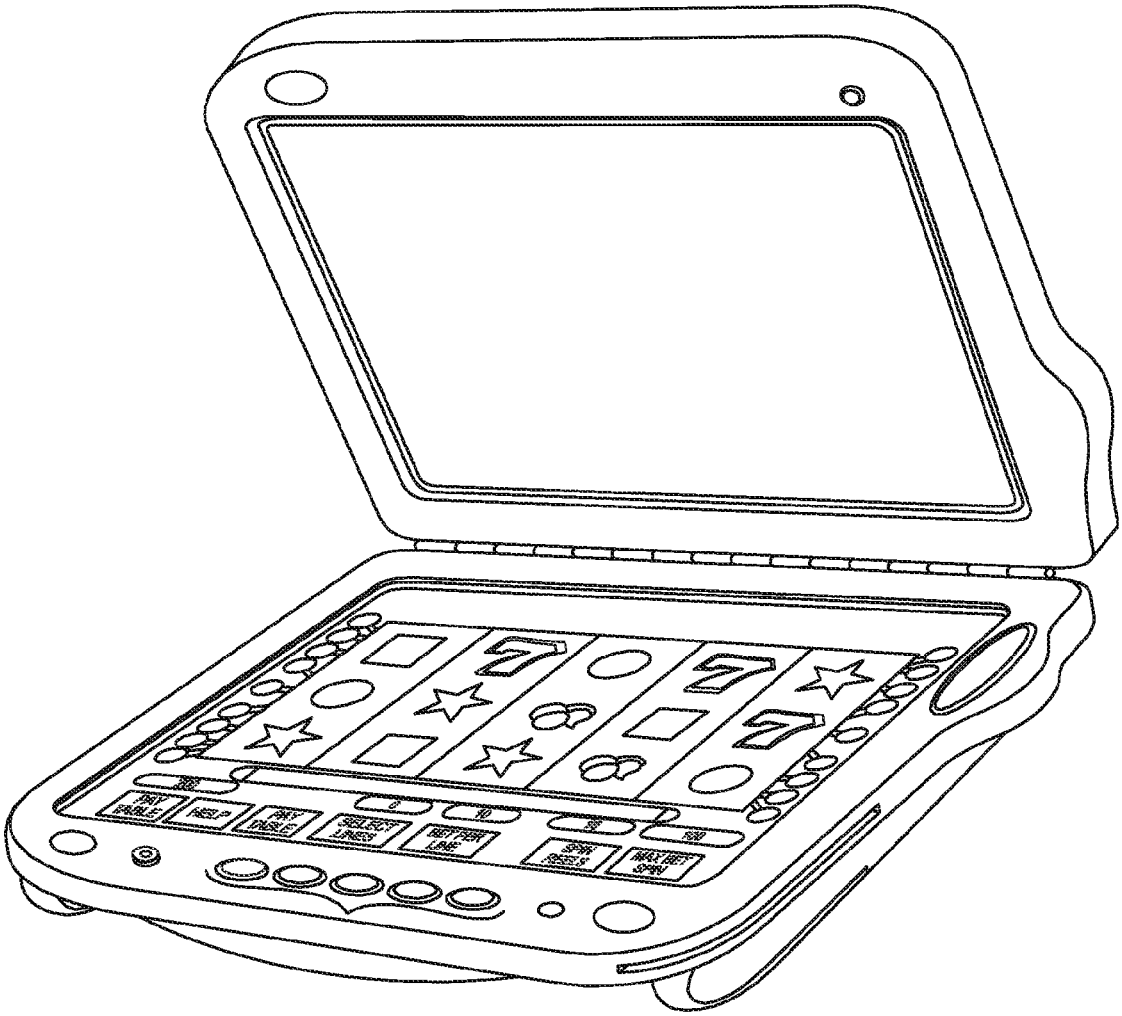
FIG. 1B PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For wager input devices, the gaming terminal 10 may include a bill validator 20, a coin acceptor 22, one or more information readers 24, one or more user interface or player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise a mouse, a joy stick, a switch, or technologies that do not rely upon touching the gaming terminal, such as a microphone, speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
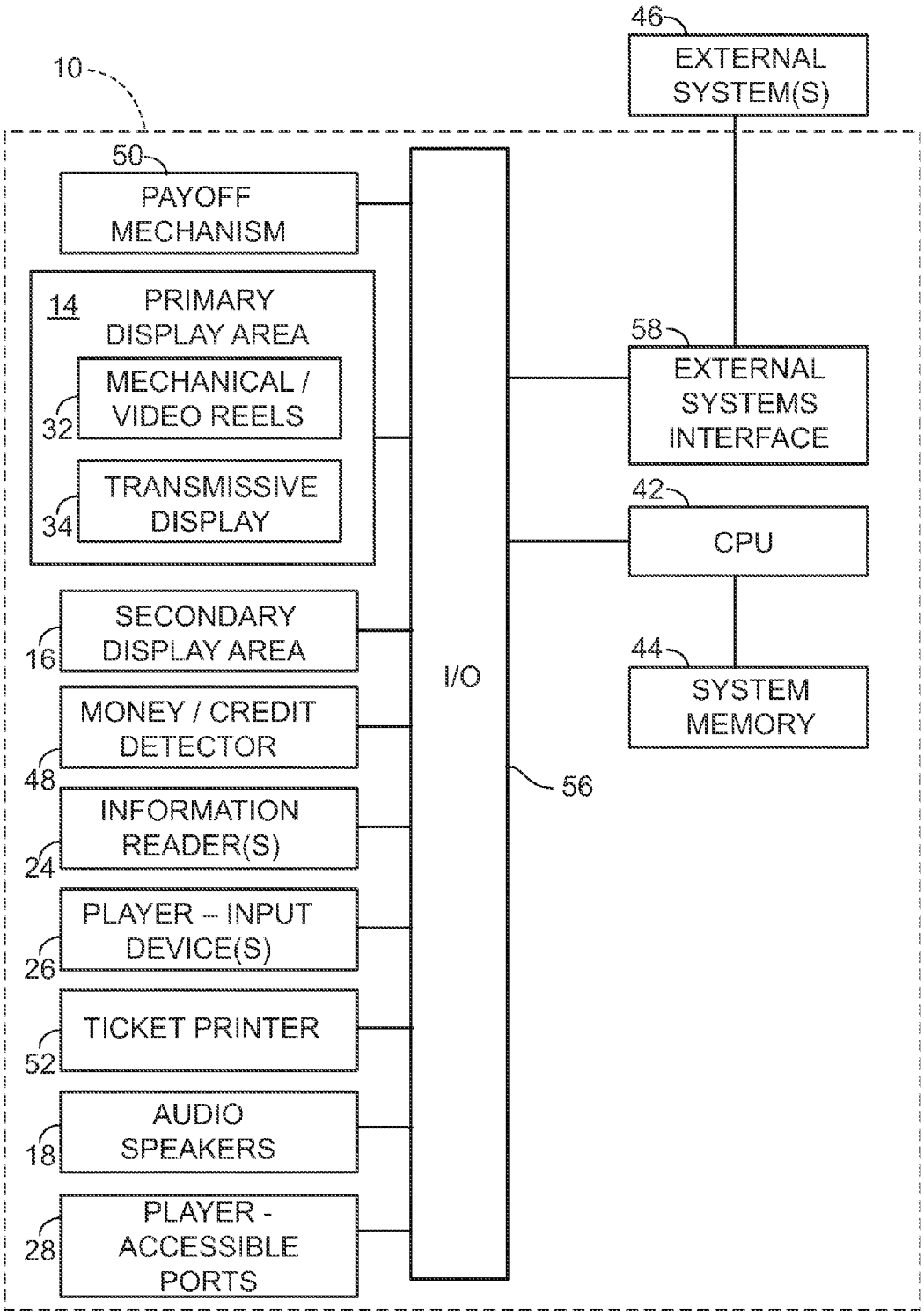
FIG. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor. In embodiments where the gaming machine 10 includes more than one processor, at least two of the processors may be located in separate enclosures from one another, and a network communication link may establish operable communication between the processors in the separate enclosures.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 sends an electronic data signal to the processor, indicating that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The electronic data signal may be, for example, an electric current, an electric voltage, an electrical charge, an optical signal, an optical element, a magnetic signal, or a magnetic element. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game(s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
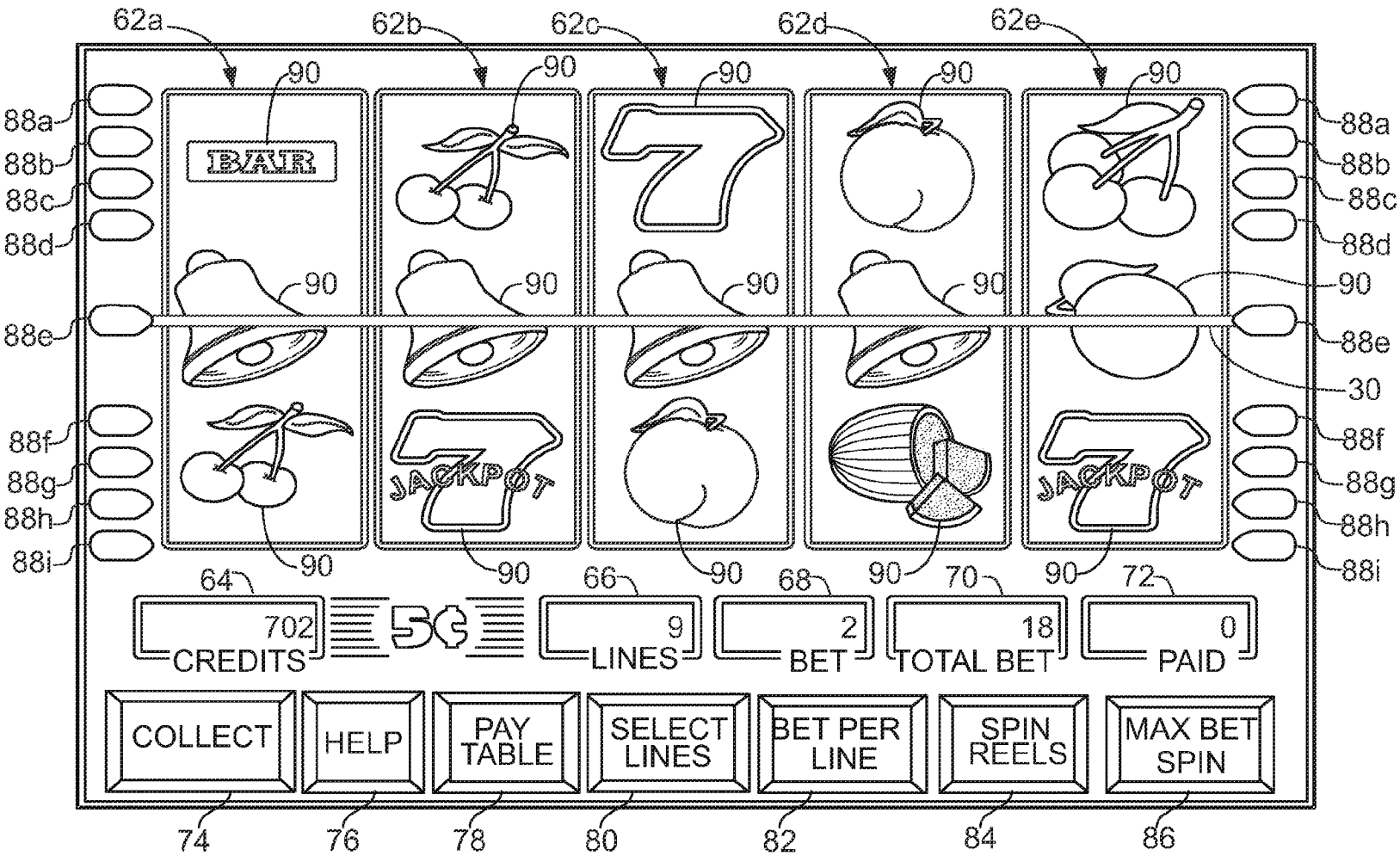
FIG. 3 PRIOR ART
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
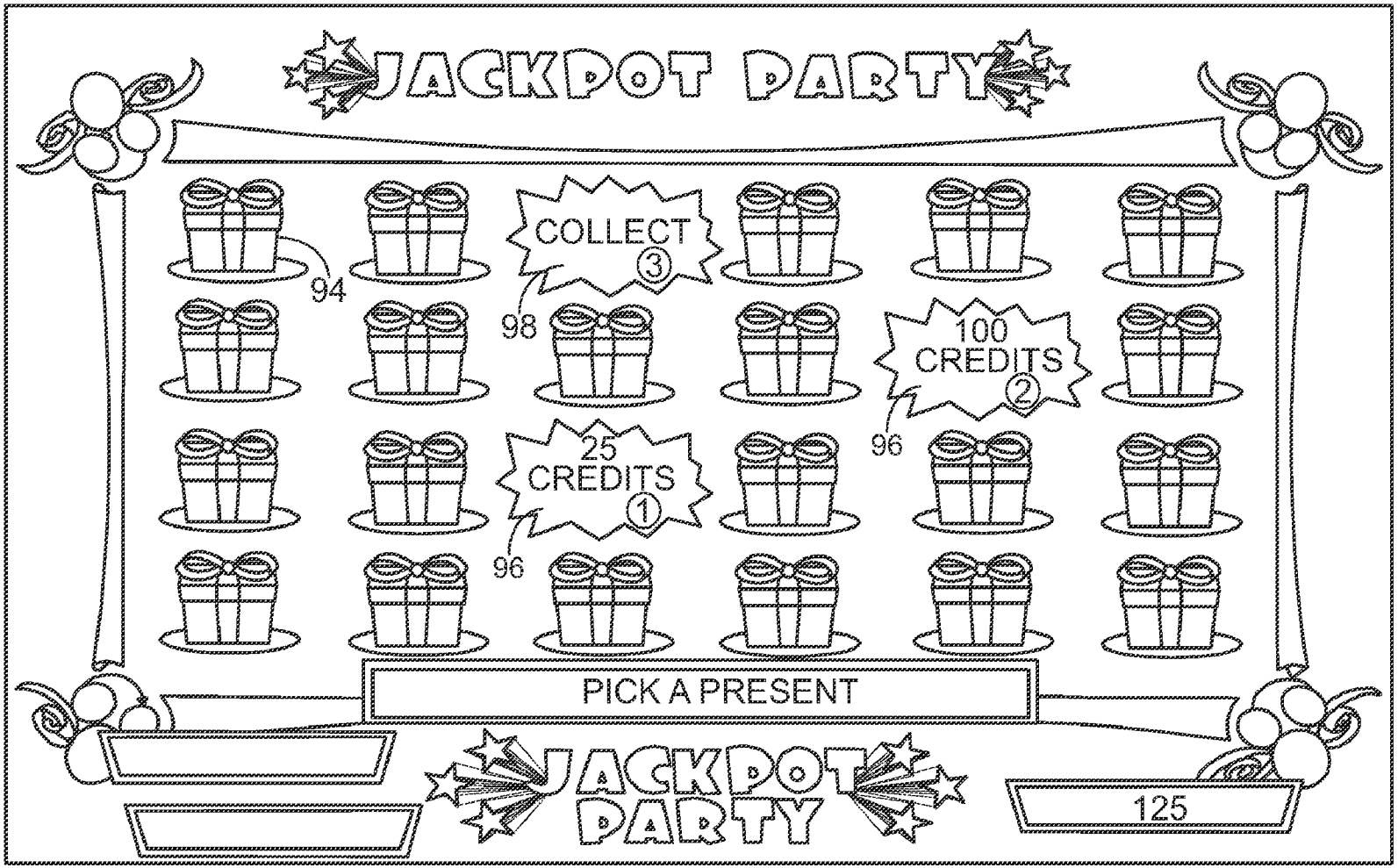
FIG.4 PRIOR ART
FIG. 4 is an image of a bonus-game screen of a wagering game that may be displayed on a gaming terminal, according to an embodiment of the present invention.

Turning now to FIG. 4, a secondary event or bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
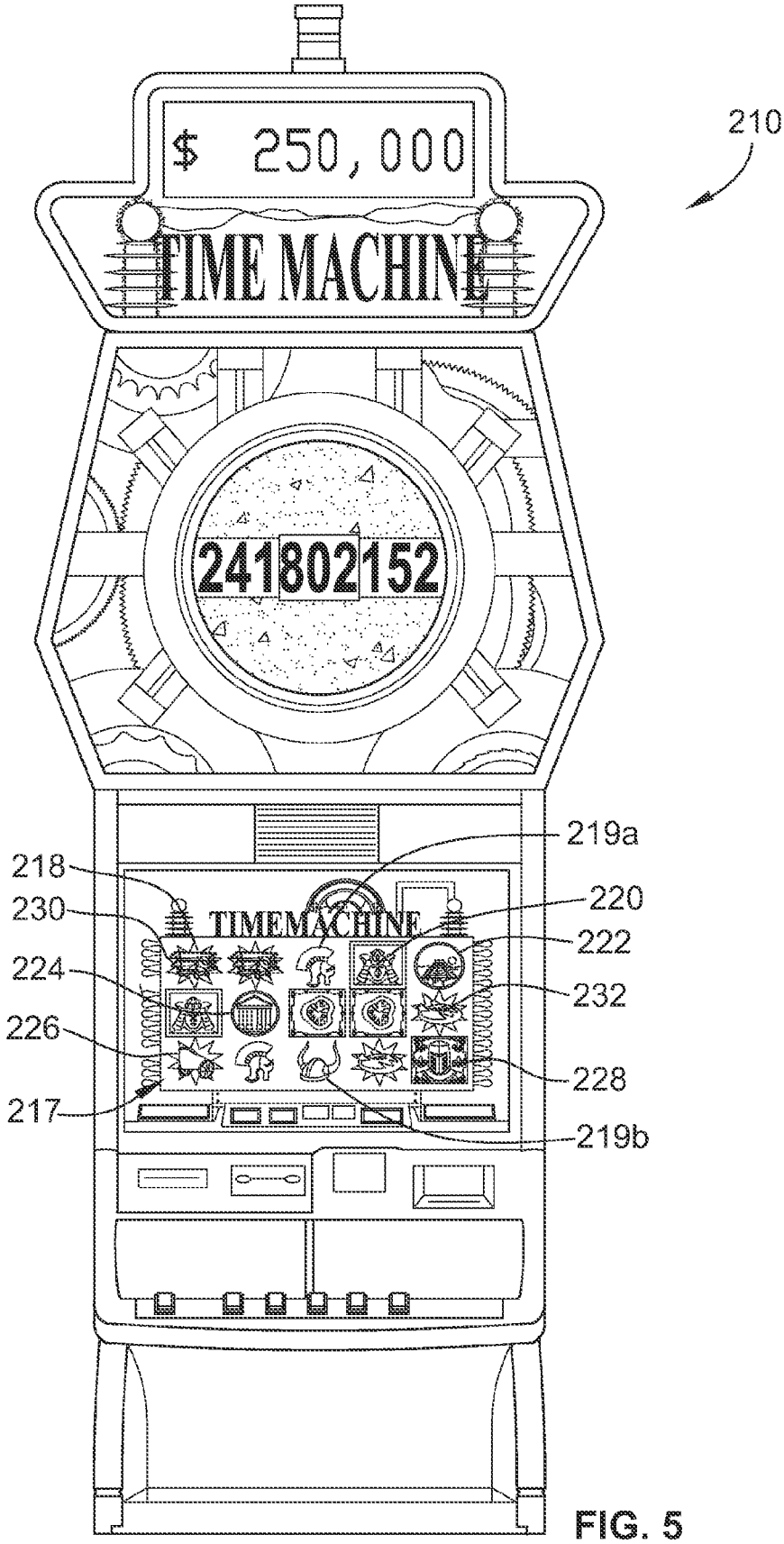
FIG. 5 is a front view of a free standing gaming machine having a time machine theme.
Figure 13:
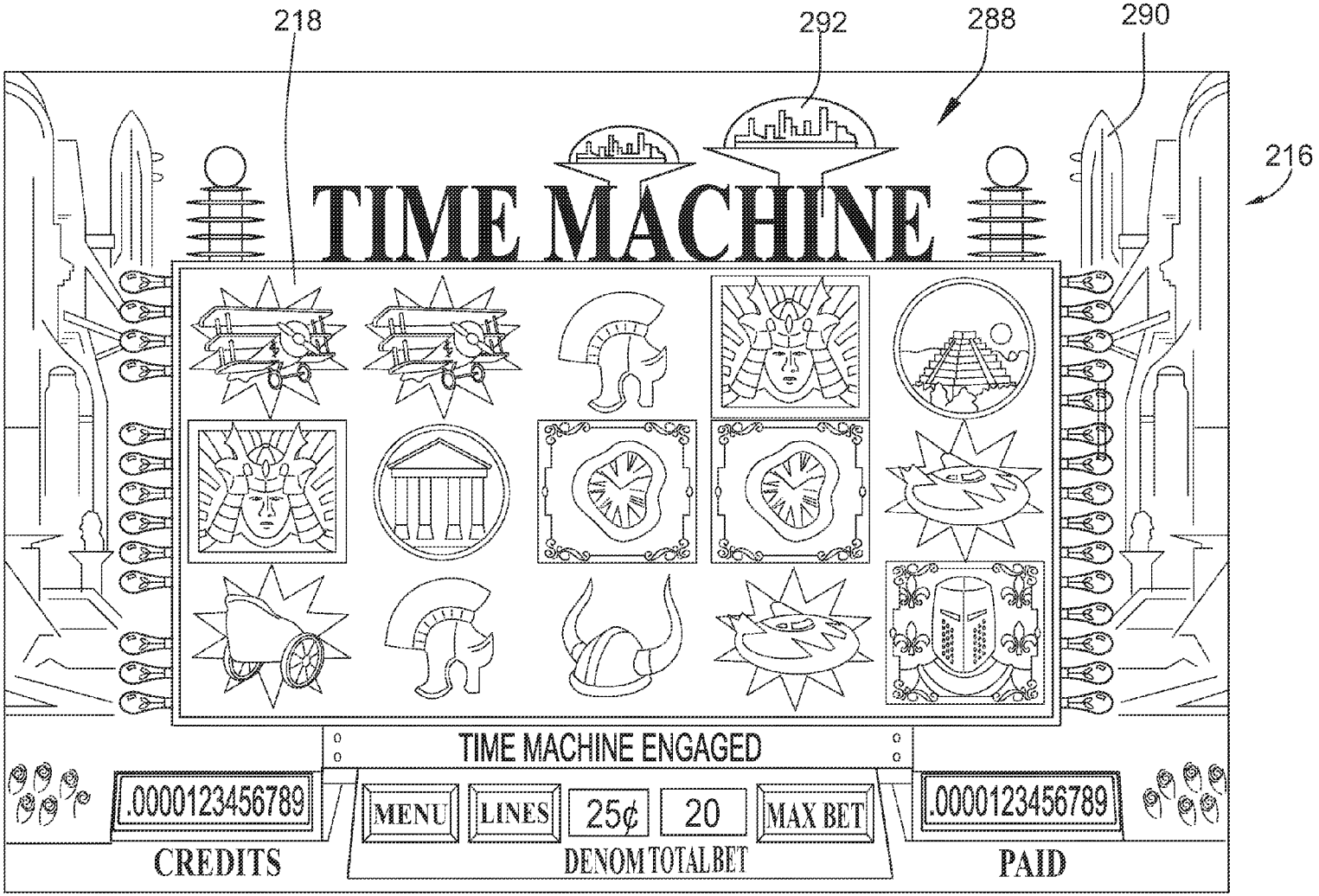
FIG. 13 is an illustration of a basic game screen subsequent to the screen of FIG. 12 incorporating a future time era thematic state.

Referring now to FIG. 5, a gaming machine 210 having a time machine theme is shown according to one embodiment. The gaming machine 210 includes three thematic states or time periods or "eras" associated, respectively, with three secondary events or bonus games: a past bonus era 212 (see FIG. 10), a present bonus era 214 (see FIG. 6), and a future bonus era 216 (see FIG. 13). Each of the three secondary events or bonus games has a different set of game-play rules associated therewith. During play, the environment of the thematic state (e.g., time era) of the previous bonus game is displayed in the background of the basic game.

In the illustrated embodiments, the interface, reels, reel symbols, and pay tables of the basic game are the same regardless of which thematic state is being displayed in the background. For example, in the illustrated embodiments, a basic game 217 includes reels 218 with symbols having valuable items relating to each of the three different thematic states. Referring to FIG. 5, for example, such items include past era symbols (e.g., helmets 219*a*, 219*b*, pharaoh 220, pyramid 222, ancient building 224, chariot 226, knight 228), present era symbols (e.g., airplanes 230), and future era symbols (e.g., spaceships 232). It is contemplated, however, that the interface, reels, and/or reel symbols may vary depending upon which of the three bonus game thematic states is being displayed. In some embodiments, certain features (e.g., wild symbols, ways of highlighting symbols, combinations thereof, or the like) of the basic game are showcased differently depending on which time era is being displayed. It is contemplated that the basic game 217 may include a stacked wild feature, a mystery stacked wild feature, or the like.

Figure 6:
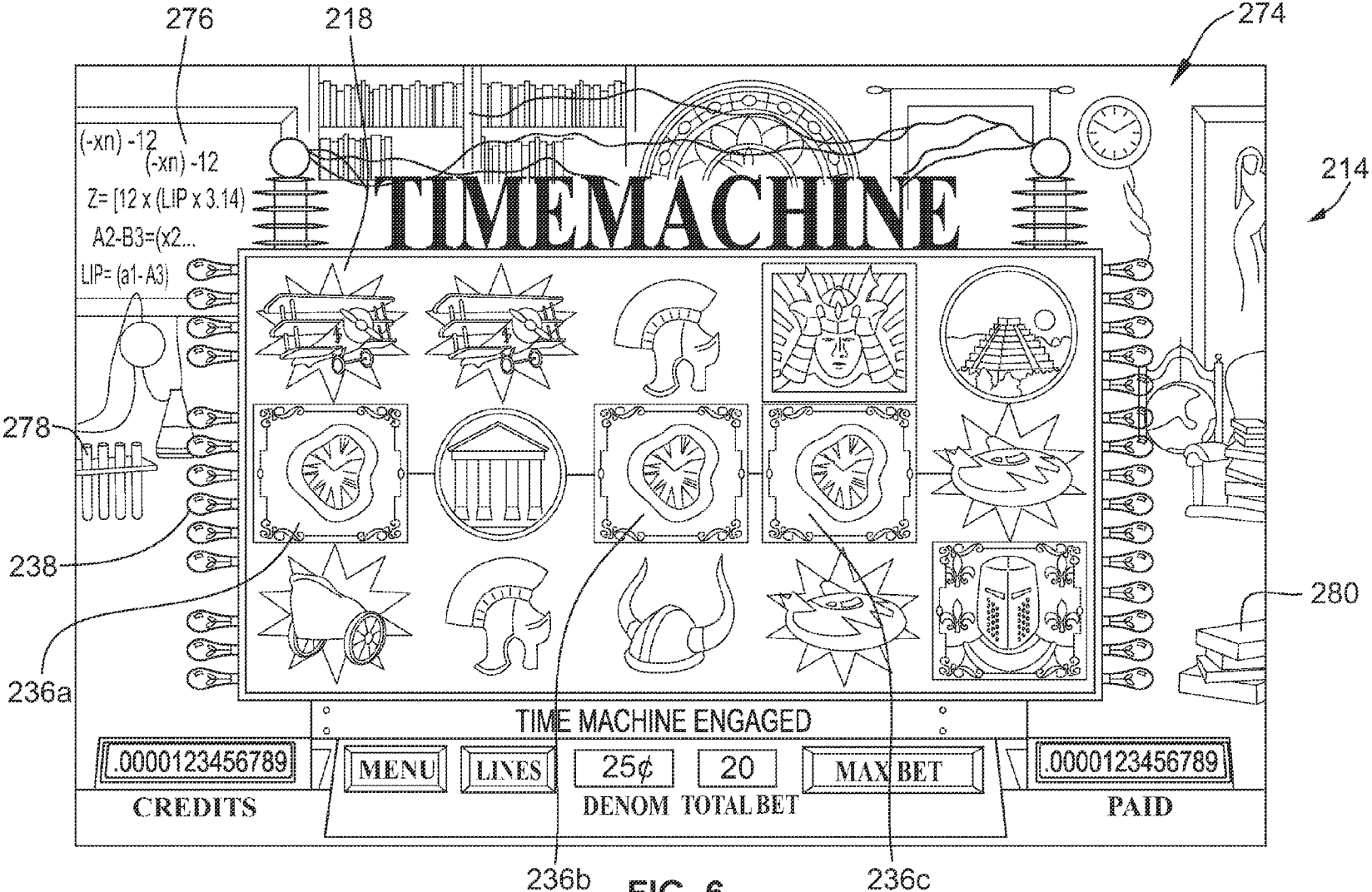
FIG. 6 is an illustration of basic game screen incorporating a present time era thematic state.
Figure 7:
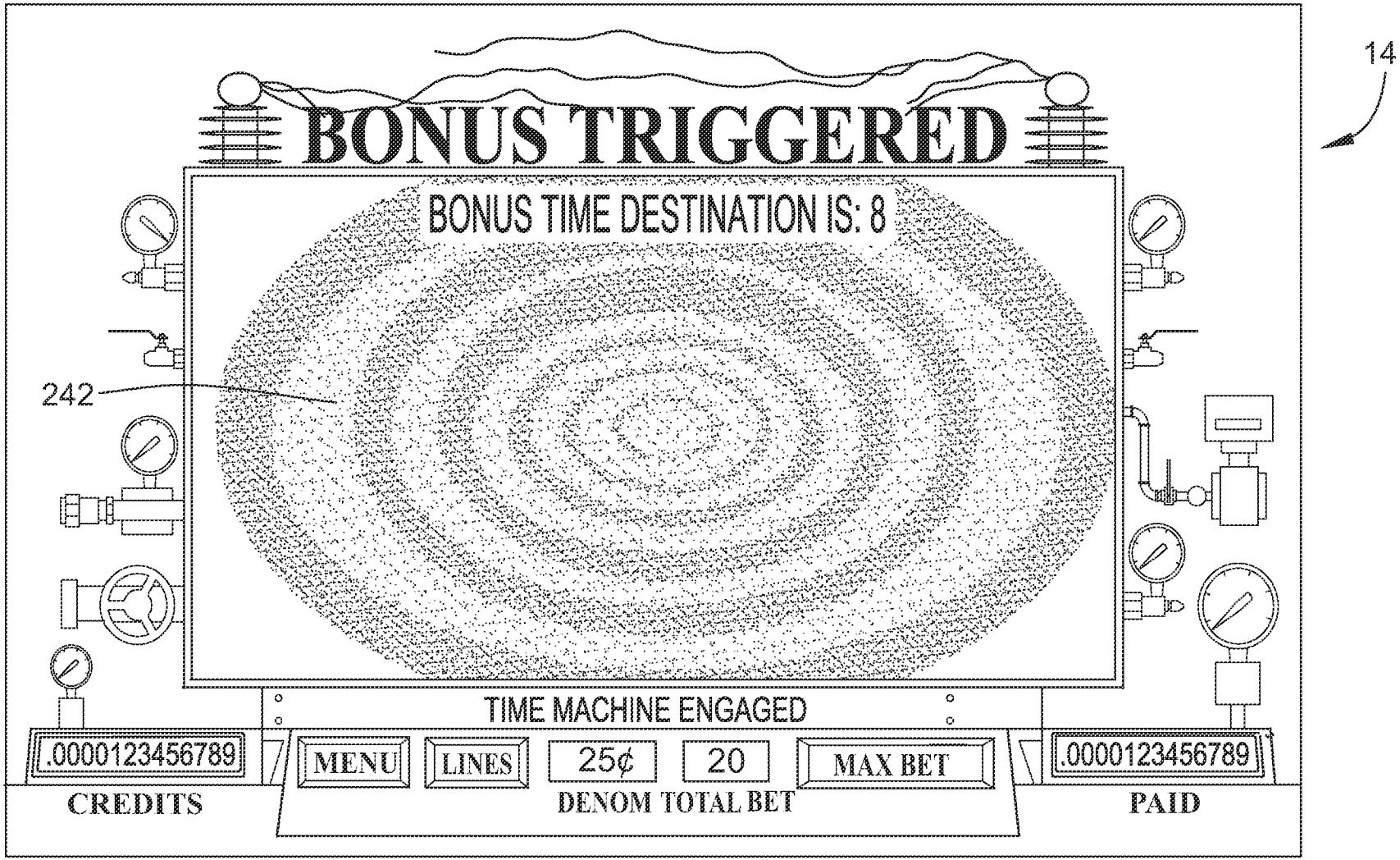
FIG. 7 is an illustration of a game screen after a secondary event has been triggered, according to one embodiment.

According to one embodiment, when a start-bonus outcome is achieved during play of the basic game, at least one of the displays (e.g., displays 14, 16 of FIG. 1*a*) portrays graphics that appear to warp the player into another time era. Referring to FIG. 6, for example, achieving three warped clock symbols 236*a*, 236*b*, 236*c* on an active payline 238 triggers a secondary event or bonus game. In the illustrated embodiment of FIG. 7, for example, after a start-bonus outcome is achieved, the primary display 14 displays concentric ellipses 242 that may appear to move. The gaming machine 210 may also include speakers for playing music and/or sounds that assist in creating the "time warp" effect. Upon achieving the start-bonus outcome, a bonus game associated with a time era other than the time era that was being displayed in the background of the basic game (e.g., present bonus era 214 in FIG. 6) when the start-bonus outcome was achieved is selected.

As shown in FIG. 6, the interface (e.g., reels 218) is displayed in a present time era over a laboratory environment 274 of the present era. For example, the laboratory environment 274 includes such graphics as a chalkboard 276, test tubes 278, books 280, and the like. The basic game 217 will remain in the present-era theme until it is sent to another time by triggering another bonus game associated with another time era.

The bonus-game era may be randomly selected by the controller with or without player input. In one embodiment, the thematic state of the secondary event or bonus game may be selected in response to player input, e.g., in response to a player selecting an event-triggering reel symbol. In another embodiment, the gaming machine 210 may alternate between displaying each of the three time eras.

Figure 8:
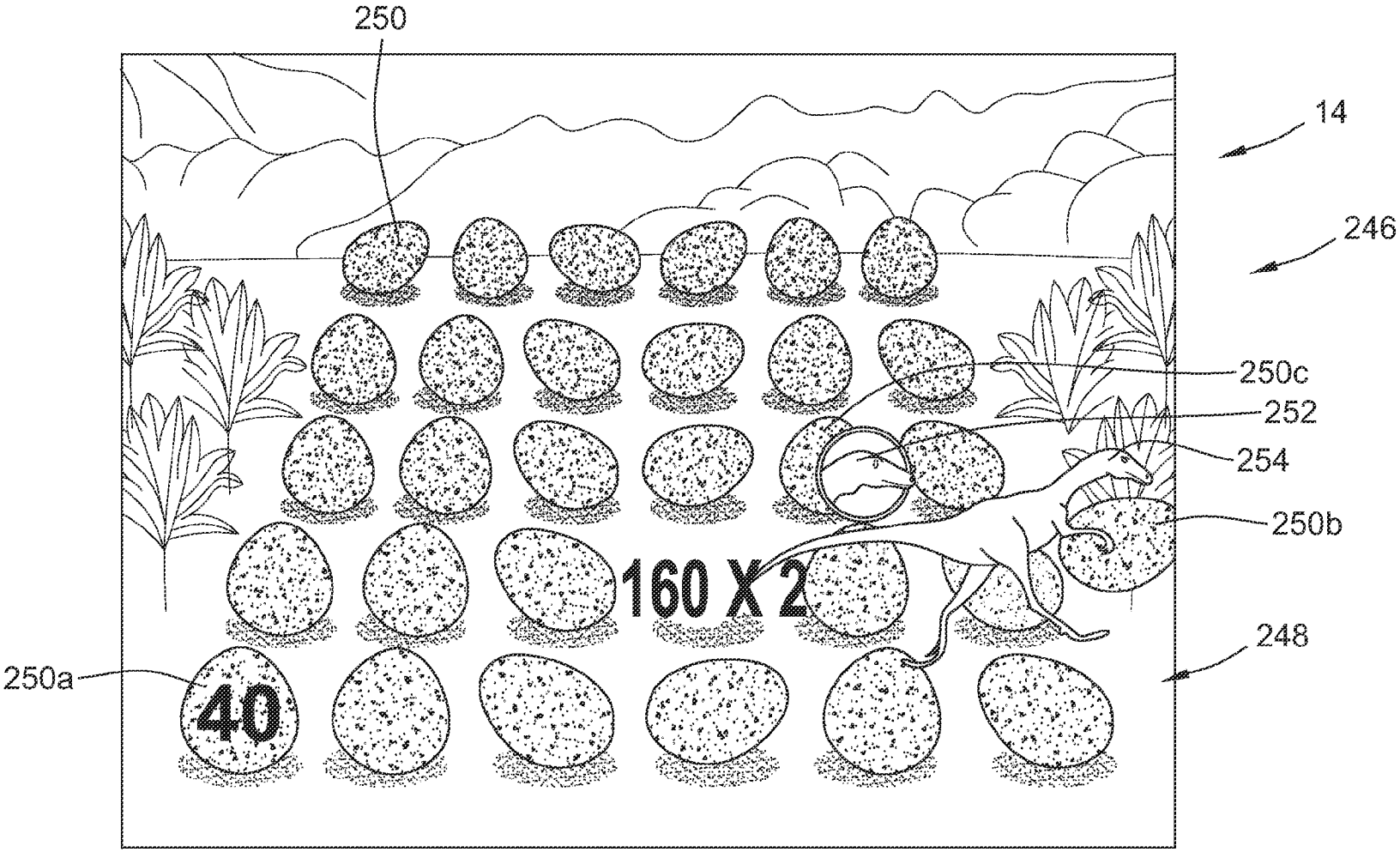
FIG. 8 is an illustration of a bonus-game screen according to one embodiment.

As shown in FIG. 8, a past era bonus game 246 was selected and is displayed on at least one of the displays (e.g., the primary display 14). In one embodiment, the game interface of the basic game (see, e.g., FIG. 6) slides away to reveal a real-time prehistoric environment 248. According to one embodiment, a point-of-view virtual camera moves down a path, appearing to place the player in front of a set of dinosaur eggs 250, each of which masks a payoff or award. The player is then prompted to select one or more of the dinosaur eggs 250. In the embodiment of FIG. 8, the player selected a dinosaur egg 250*a* associated with an award value of 40 credits, an egg 250*b* associated with 160 credits, and an egg 250*c* that revealed a predator icon 252. Selecting the egg 250*c* masking the predator icon 252 causes a small predator dinosaur 254 to appear on the display 14 and take away an egg (e.g., egg 250*b*) that has already been awarded, which causes the award value associated with that egg 250*b* (e.g., 160 credits) to be increased. In the illustrated example, the award of 160 credits associated with the egg 250*b* taken away by the predator dinosaur 254 is increased by a multiple of 2. If the predator icon 252 is revealed prior to any awards being revealed, the predator dinosaur 254 may reveal and remove an egg 250 masking an end-bonus trigger. This is helpful to the player because it reduces the player's chances of selecting the end-bonus trigger. In one embodiment, selection of an end-bonus trigger may cause the egg 250 associated therewith to crack, causing a large dinosaur (e.g., a mother velociraptor) to be displayed as lunging toward the player, thereby ending the bonus game. Another dinosaur may enter, snatch a baby raptor emerging from the cracked egg away, and run off, thereby saving the player's bonus and allowing the player to continue selecting eggs 250. If a small dinosaur enters and takes an egg 250, the player is awarded the credit award associated with that egg 250.

In another embodiment, the past era bonus event includes a triceratops appearing behind the reels during a reel spin. The appearance of the triceratops transforms at least one of the reels into a wild reel, which is wild for all or substantially all symbols (e.g., all symbols except bonus symbols or progressive symbols).

Figure 9A:
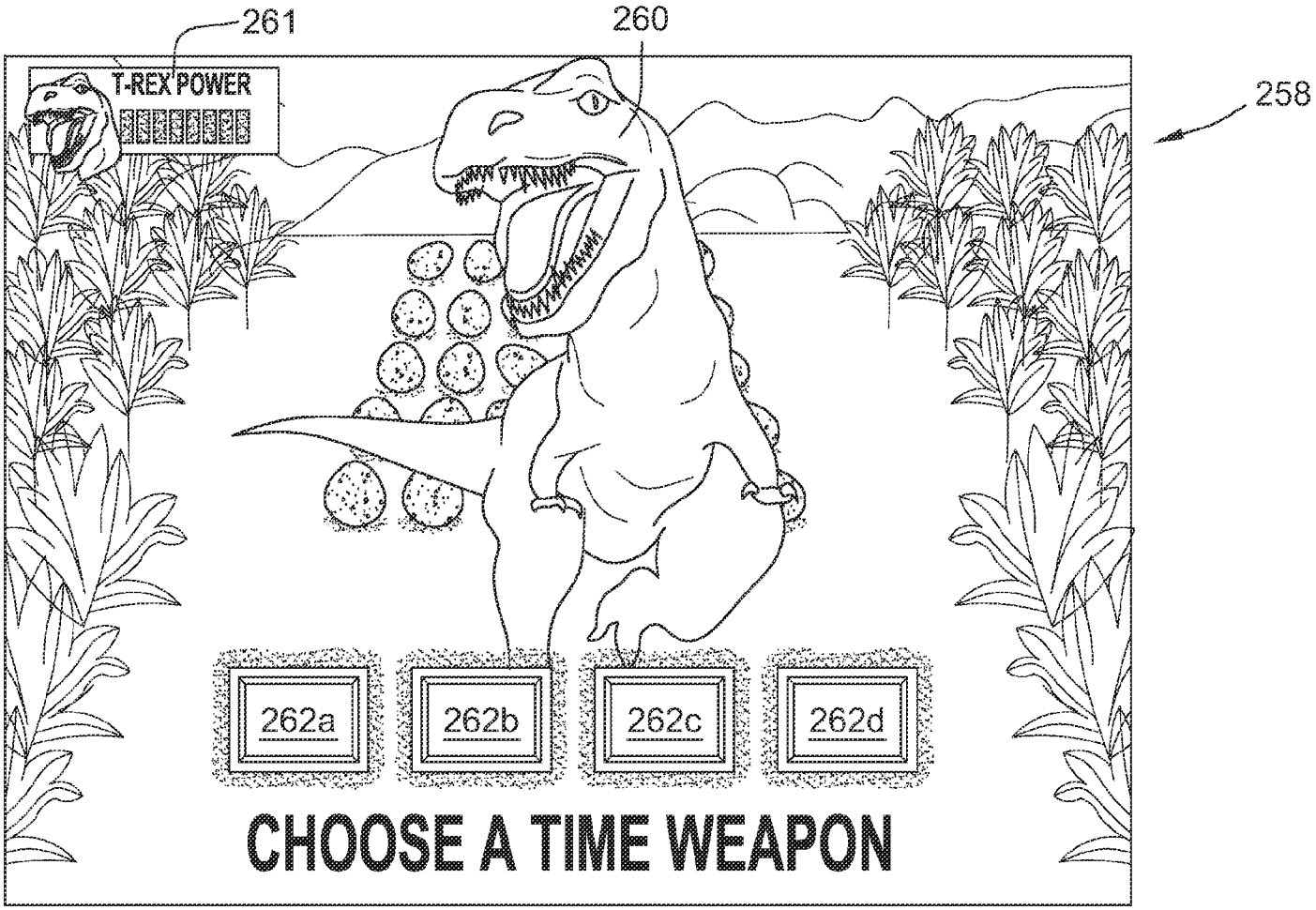
FIG. 9*a* is an illustration of a bonus-game screen according to another embodiment.
Figure 9B:
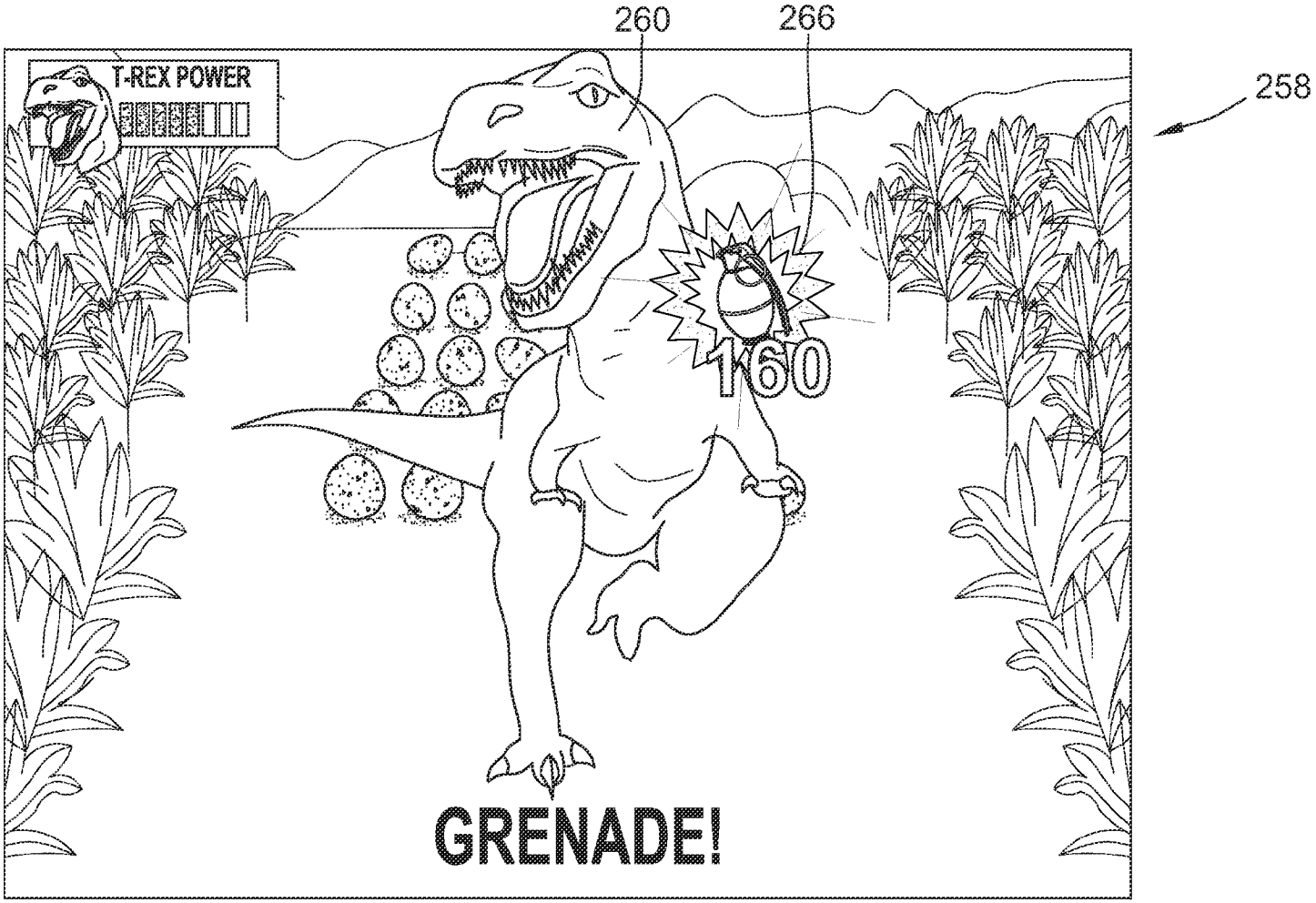
FIG. 9*b* is an illustration of a bonus-game screen subsequent to the screen of FIG. 9*a*.

FIG. 9*a* illustrates a game screen displaying an additional or an alternative past era bonus game 258. In the embodiment of FIG. 9*a*, a T-Rex 260 is randomly displayed as entering the past era bonus game 258. The T-Rex 260 may be displayed as moving toward and/or chasing the player. As shown in FIG. 9*a*, the player is prompted to select a tile 262*a-d*, each of which masks a time-based weapon from a particular time era for trying to stop the T-Rex 260. The player may receive one or more chances to select a weapon and/or to try to empty the T-Rex's energy meter 261. The weapons may include, for example, a stick, a wrench, a flash can, TNT, a grenade, or the like. Each type of weapon is associated with a particular credit value and/or potential power for decreasing the T-Rex's energy meter 261. As shown in FIG. 9*b*, for example, the player selection reveals a grenade 266 associated with an award of 160 credits. If the energy meter 261 is not fully emptied after the player completed his or her weapon selections, the bonus game ends. If, however, the player stuns the T-Rex 260 by fully emptying the energy meter 261, the player may continue selecting eggs 250 (see FIG. 8). Alternatively, the player may have a final weapon selection in which the player may select from four selections, one of which masking TNT and the remaining three masking credit values. If the player reveals a credit award, the T-Rex 260 leaves and the bonus continues. If the player reveals the TNT, the T-Rex 260 is stopped, a T-Rex credit award is awarded, and the bonus continues.

According to another embodiment, the past era bonus game is played on two screens (e.g., the primary display 14 and the secondary display 16). The player advances through a prehistoric environment for bonus awards on the primary display 14. The secondary display 16 displays a stone portal with four missing gem keys: ruby, emerald, amethyst, and sapphire. The bonus may begin with either the player being prompted to select one of three path arrows or with the player immediately encountering a T-Rex. When a path arrow is selected, the player advances through the path to reveal any of a credit award, an egg pick, a ruin pick, a gem key, or a T-Rex encounter. If a gem key is revealed within an arrow path selection, egg pick, or ruin pick, the gem moves up to the secondary display 16 and gets locked in a portal for a credit award. The credit award for each gem key found within the bonus increases in value. If the fourth and final gem key is revealed, after the gem moves up to the secondary display 16 and gets locked in the portal, the portal opens to reveal a final credit award, which immediately ends the bonus game. If the egg pick is revealed, the player is prompted to select one of a plurality of eggs as described above with respect to FIG. 8. The eggs may reveal a credit award, a gem key, or a baby raptor. If the ruin pick is revealed, the player is prompted to select one of a plurality of displayed ruins for a credit award or gem key. If the T-Rex is encountered, the bonus screen and game described above with respect to FIGS. 7*a*, 7*b* may be triggered.

Figure 10:
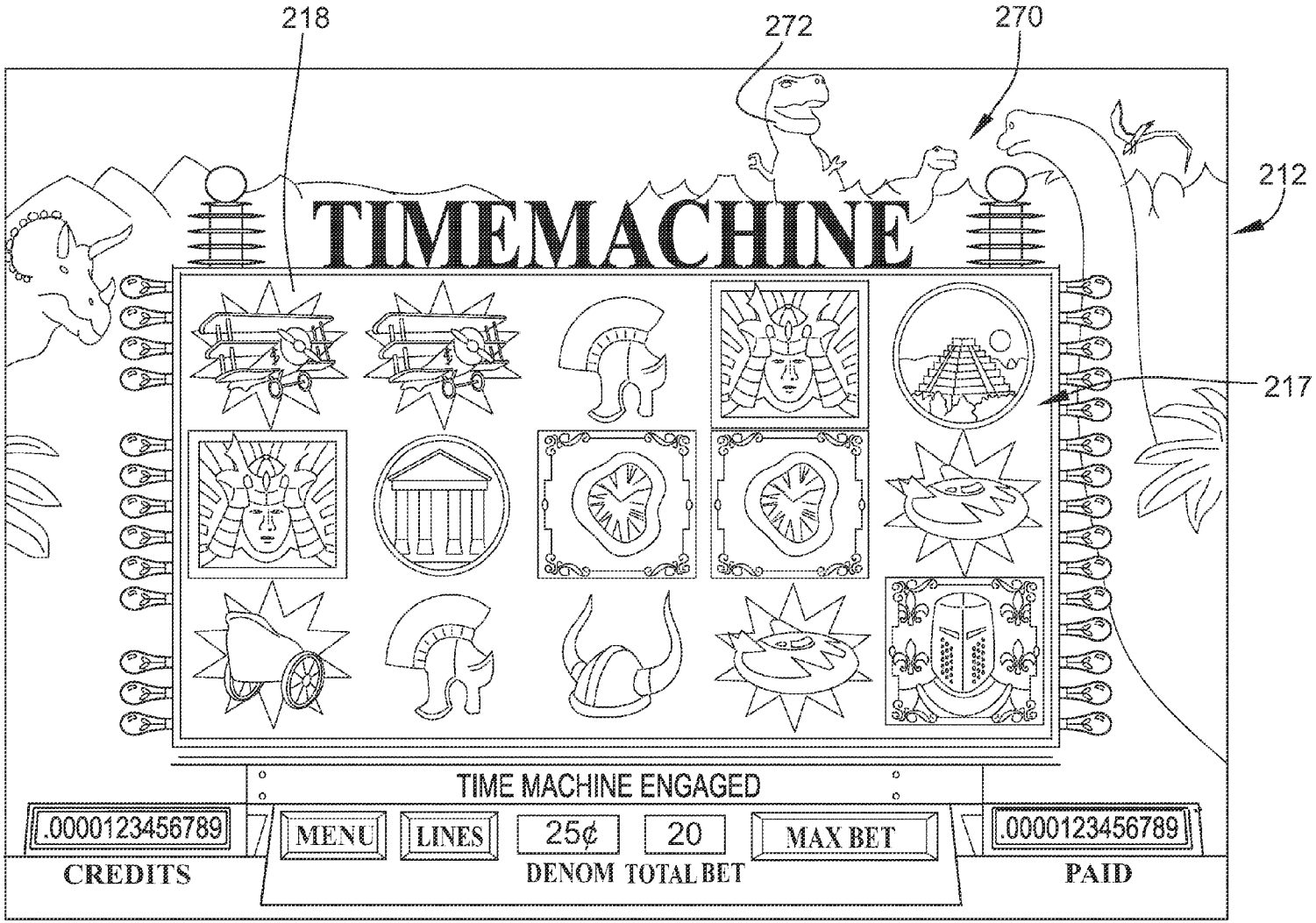
FIG. 10 is an illustration of a basic game screen subsequent to the screen of FIG. 9*b* incorporating a past time era thematic state.

Referring to FIG. 10, after the past era bonus ends, the basic game 217 is again displayed with the reels 218 that were used in the previous basic game 217. The display region now includes a prehistoric environment 270 corresponding with the previously-played past era bonus game 246, 258. For example, the prehistoric environment 270 includes dinosaurs 272 and the like. The basic game 217 will continue to be displayed with the prehistoric environment 270 in the background until the basic game 217 is "sent to another time era" by triggering another bonus game associated with another time era.

Figure 11:
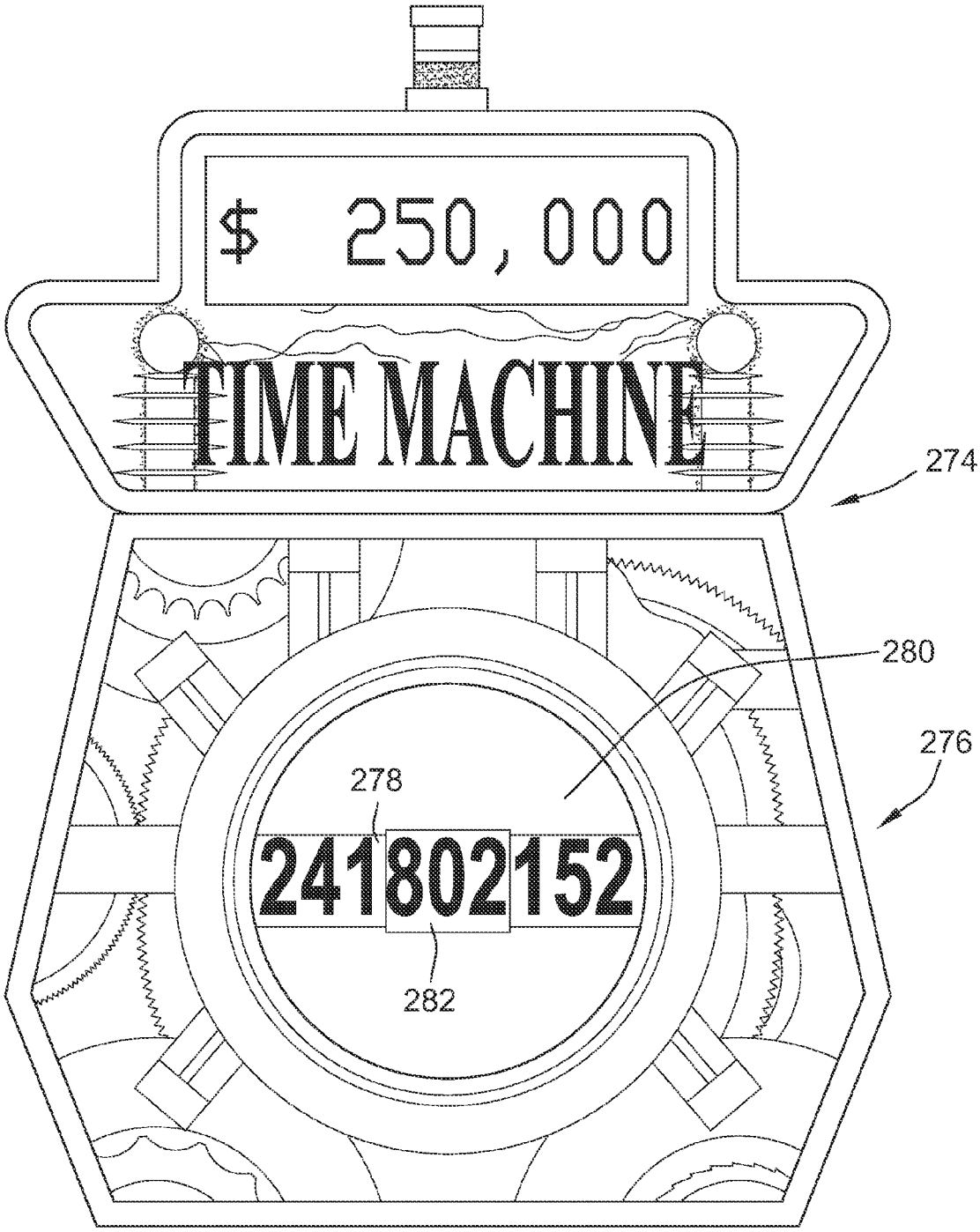
FIG. 11 is an illustration of a top box bonus game according to one embodiment.

Referring to FIG. 11, a top box display 274 is shown displaying a present era bonus game 276, as opposed to the past era bonus games 246, 258. In the present era bonus game 276, the player is prompted to look up at the top box display 274, where a range of numbers 278 move horizontally across the face of a clock 280. In one embodiment, the numbers eventually slow down to a stop. The group of numbers that appear in a box 282 reflect the amount of credits awarded to the player. For example, in the embodiment of FIG. 11, the player is awarded 802 credits. In another embodiment, the top box display 274 may also display warp outcomes that "warp" the player to an era associated with another bonus game at a multiplied value.

Alternatively or additionally, the present era bonus game utilizes two displays during play. A handle lever is displayed and highlighted on the primary display 14. The secondary display 16 displays three reel dials presented vertically with a gold frame centered over the dials. Starting from the left, the first dial includes multiplier values with blank spaces between each multiplier. The second dial includes single-digit number values. The third dial includes double-digit number values. The player is prompted to touch the lever in the primary display 14 to activate the dials in the secondary display 16, which activates the dials to begin spinning and slow to a complete stop. Once all of the dials stop rotating, the value that is displayed in the frame is the final credit amount awarded to the player. This embodiment may also be implemented as one of the other bonus games (e.g., the past era bonus game, the future era bonus game).

Figure 12:
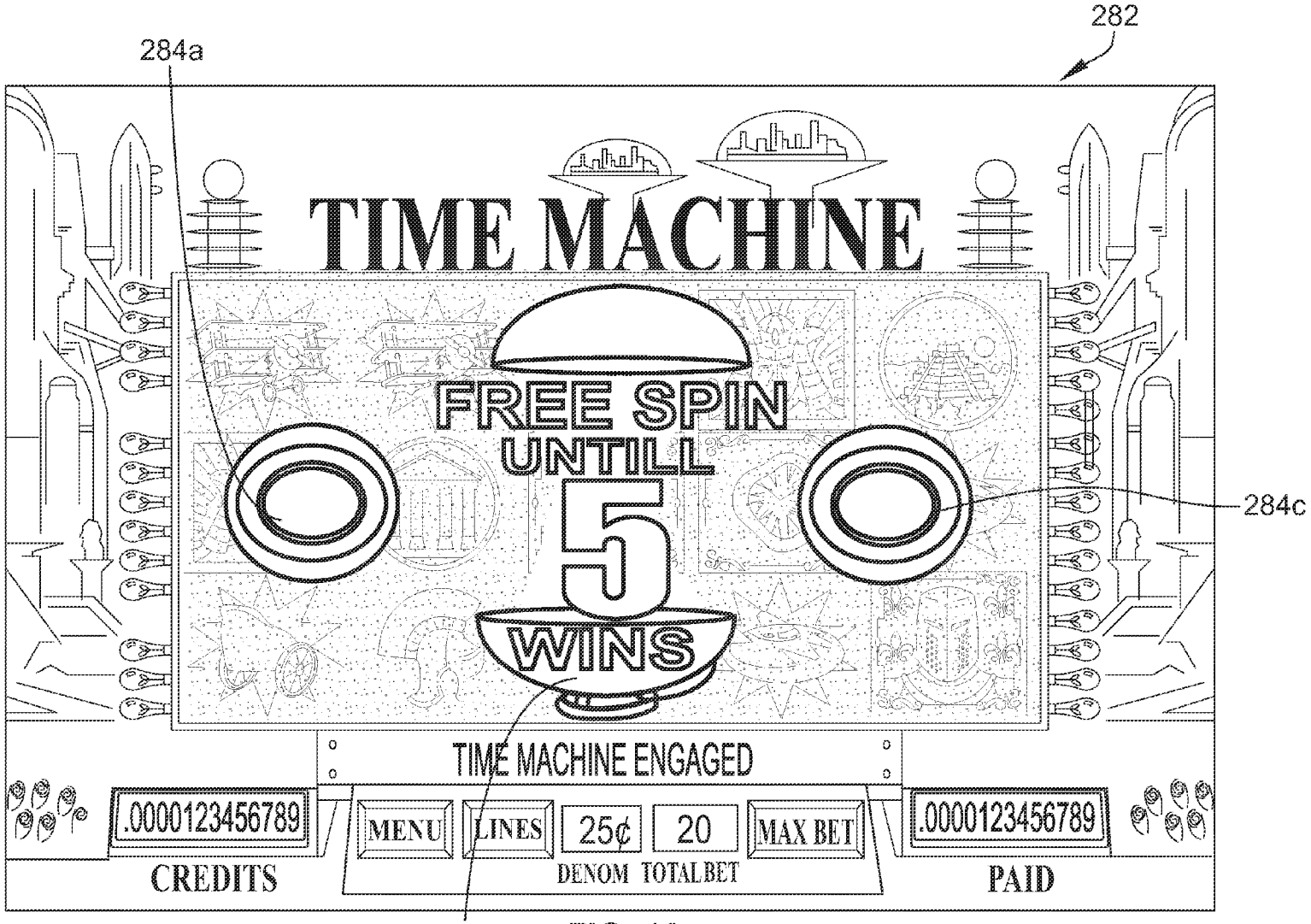
FIG. 12 is an illustration of a bonus game screen according to one embodiment.

FIG. 6 shows the primary display 14 displaying the basic game 217 after the present era bonus game of FIG. 11 concludes. FIG. 12 illustrates the display 14 after a start-bonus outcome is achieved and a future era bonus game 282 has been selected. In the future era bonus game 282, the player is prompted to select an orb 284*a-c* to reveal an award. In the embodiment of FIG. 12, the player selected the middle orb 284*b*, which reveals an award providing the player with free spins until five wins are achieved. In one embodiment, during the future era bonus game 282, the reels spin in a non-standard way to create a futuristic effect.

In another embodiment, the future era bonus game utilizes two screens during play. The player is awarded one or more free spins and one future spin on the primary display 14. The player collects any special symbol that appears on the reels during the free spins. The position at which the special symbol appeared on the reels of the primary display 14 is replicated on a corresponding positional grid in the secondary display 16. If a special symbol re-appears on the reels where a special symbol has already been collected, that special symbol is not accumulated. Once the initial free spins are completed, the future spin becomes active. The player is prompted to press an on-screen button to start the future spin, during which all collected special symbols in the secondary display 16 are collected and placed back on the reels on the primary display in the same position. Once that is done, all of the reels spin with the collected special symbols locked in position above the reels. Once the reels stop, all line wins are evaluated. An alternate set of symbols is used during free spins. Winning combinations for these reels are identical to those of the basic game except that the additional bonuses cannot be triggered, and, thus, bonus and progressive symbols do not appear on the reels. The bet per line and the active paylines remain the same as the spin that triggered the bonus. This embodiment may also be implemented as one of the other bonus games (e.g., the past era bonus game, the present era bonus game).

As shown in FIG. 11, once the future era bonus game 282 ends, the primary display 14 returns to the basic game 217 having an interface (e.g., reels 218) over a futuristic utopian environment 288. The futuristic utopian environment 288 includes graphics such as rocket ships 290, space stations 292, and the like. The theme surrounding the basic game 217 will remain in the future-era theme until it is sent to another time era by triggering a different type of bonus associated with another time era.

As shown in the illustrated embodiments, the secondary event or bonus game described herein may cause the theme surrounding the reels 218 of the basic game 217 or the theme over which the reels 218 to reflect the theme of the previously-played secondary event. Alternatively or additionally, the theme of the previously-played secondary event may be displayed on the reels 218 of the subsequent basic game 217 themselves. For example, the reels 218 may include more (or all) symbols of the time era of the previous secondary event.

Figure 14:
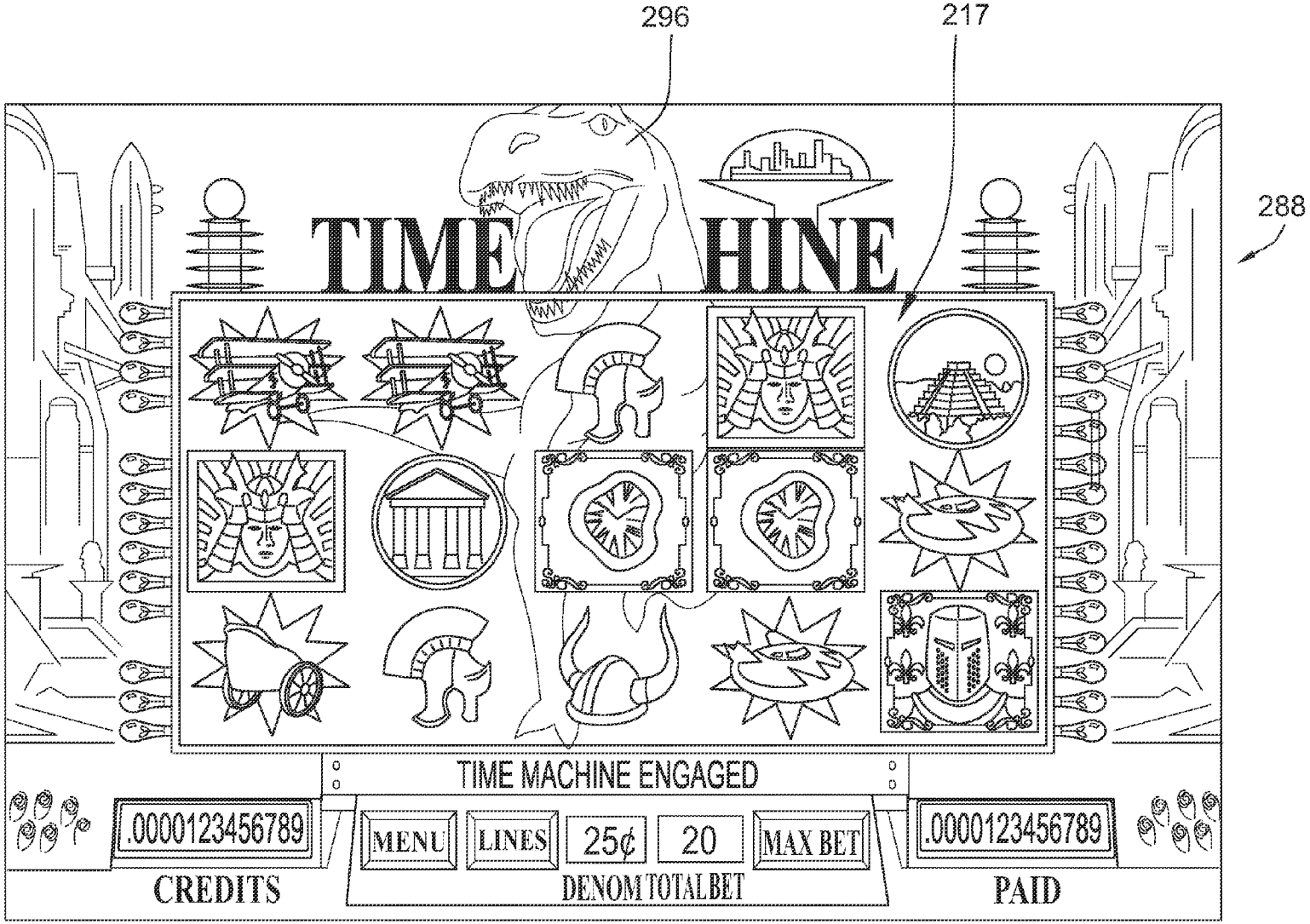
FIG. 14 is an illustration of a bonus-game screen according to another embodiment.

According to another embodiment, a "time rip" may occur at a random time(s) during the basic game 217 and/or the bonus game(s). The time rip may warp items from other time eras into those displayed in the basic game environment or the currently-displayed bonus game to affect game play. For example, FIG. 14 illustrates the basic game 217 of FIG. 11 displayed over the futuristic utopian environment 288 in which a time rip causes a T-Rex 296 to appear and "warp" the basic game 217. Such "warping" may cause symbols to fall and/or wild symbols to replace other, existing symbols. In another embodiment, during a past era bonus game (see FIG. 6), a force field may be awarded to a player that stops the large dinosaur (e.g., the mother velociraptor) so that the player may continue selecting eggs 250.

It is contemplated that thematic states other than time eras may also be implemented according to the concepts described herein. Some non-limiting examples of such thematic states include temperature (e.g., hot, moderate, cold), decades (e.g., sock hop, disco, break dancing), movie themes, or the like. A different number of thematic states (more or less than three) may also be used.

It is further contemplated that the secondary event or bonus game (e.g., past era bonus game, present era bonus game, future era bonus game) may involve multiple sequential segments having different states. Thus, upon returning to the basic game of the wagering game, the basic game would reflect the thematic state used in the last segment of the secondary event or bonus game.

According to one embodiment, the gaming machines described herein include a sensory immersion game including features that assist in making a player feel as if he or she is inside of a time machine. For example, the gaming machine 210 may include 3D or surround sound speakers mounted on a chair of the gaming machine 210, for example typically behind a player's head at the top of the chair. Celebratory music or other sounds may be played back through the 3D or surround sound speakers of the chair upon occurrence of the triggering event, thereby making the player feel as if he or she is inside of the time machine. For more information regarding such surround sound gaming machine chairs, the reader is referred, for example, to the commonly-assigned U.S. Pat. No. 7,367,886 entitled "Gaming System With Surround Sound" and issued May 6, 2008, which is incorporated herein by reference in its entirety.

Figure 15:
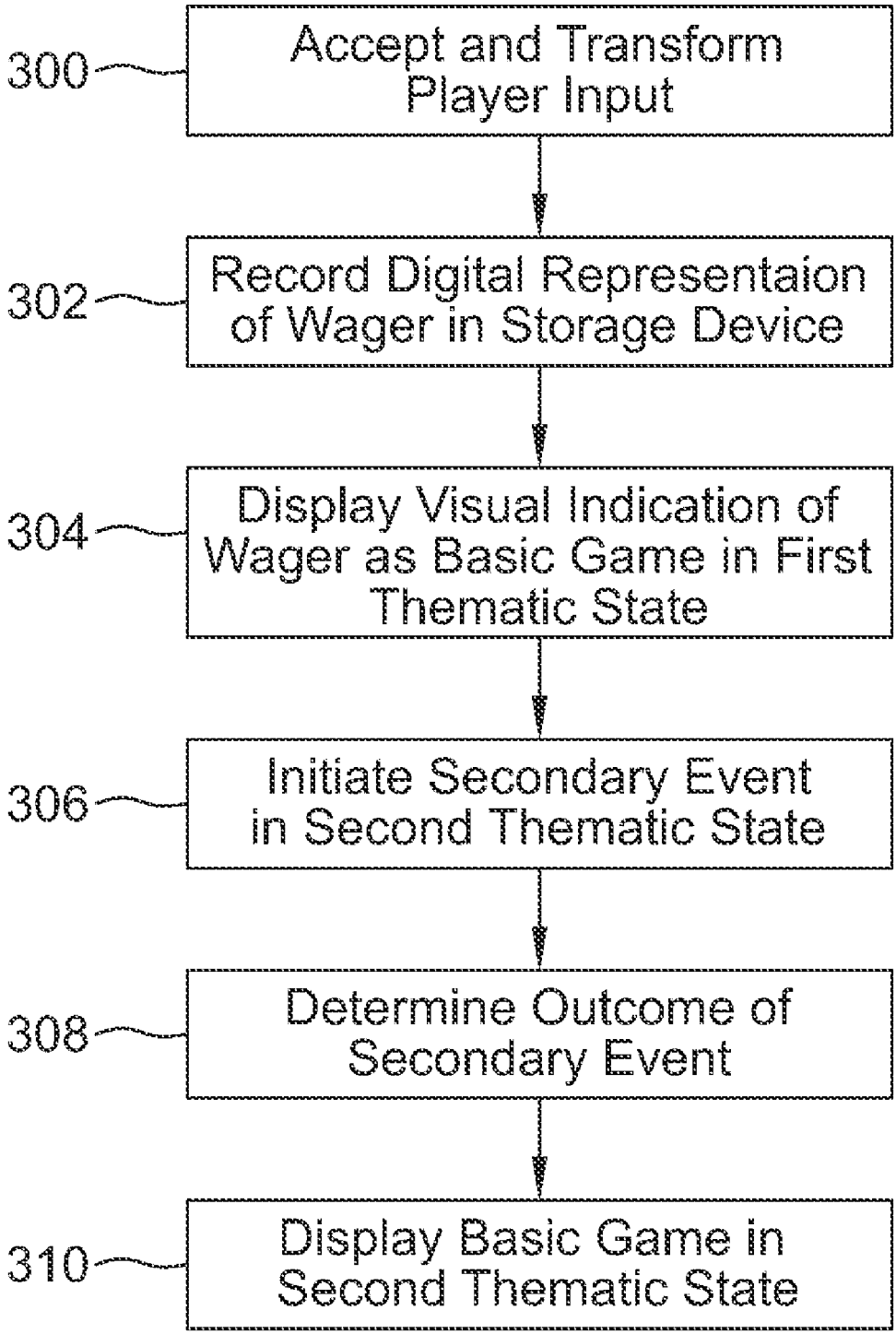
FIG. 15 is a flowchart for an algorithm that corresponds to instructions executed by a controller in accord with at least some aspects of the disclosed concepts.

FIG. 15, described by way of example above, represents one algorithm that corresponds to the at least some instructions executed by the controller 34 and/or external systems 50 in FIG. 2 to perform the above described functions associated with the disclosed concepts. At step 300, a user interface device accepts a player input and transforms the player input to electronic data signals indicative of a wager to play the wagering game. At step 302, one or more processors interprets the wager from the data signals and causes the recording of a digital representation of the wager in a storage device. At step 304, at least one of the processors causes the display of a visual indication of the wager on a display device, wherein the visual indication includes a basic game in a first thematic state. At step 306, at least one of the processors initiates a secondary event, the secondary event including a second thematic state. At step 308, an outcome of the secondary event is determined. At step 310, at least one of the processors, upon concluding the secondary event, causes the display of the basic game in the second thematic state.

Each of these embodiments and obvious variations thereof is contemplated as falling within the spirit and scope of the claimed invention, which is set forth in the following claims.

What is claimed is:

1. A gaming system comprising:

one or more displays;

a wager input device for receiving a wager to play a wagering game having a plurality of possible thematic states; and a controller coupled to the one or more displays and the wager input device, the controller operative to cause at least one of the displays to display a basic portion of the wagering game in a first thematic state of the plurality of possible thematic states, trigger a secondary event of the wagering game, cause at least one of the displays to display the secondary event of the wagering game in a second thematic state of the plurality of possible thematic states, and at a conclusion of the secondary event, cause at least one of the displays to display the basic portion of the wagering game in the second thematic state.

2. The gaming system of claim 1 wherein the plurality of possible thematic states include a past-era theme, a present-era theme, and a future-era theme.

3. The gaming system of claim 1 wherein the second thematic state of the secondary event is randomly selected by the controller without player input.

4. The gaming system of claim 1 wherein the second thematic state of the secondary event is selected by the controller in response to player input.

5. The gaming system of claim 1 wherein the basic portion of the wagering game includes a plurality of reels.

6. The gaming system of claim 1 wherein each of the thematic states is associated with a different type of secondary event having different game-play rules.

7. The gaming system of claim 5 wherein, at the conclusion of the secondary event, the plurality of reels of the basic portion of the wagering game is displayed over the second thematic state.

8. A method of conducting a wagering game for a human player, the wagering game including a game sequence in which a player provides an input and a wagering game outcome is determined, the wagering game including a basic game, a secondary event, and a plurality of possible thematic states, the method comprising the acts of:

using an interface device to accept the player input, and transforming the player input to electronic data signals indicative of a wager to play the wagering game;

using one or more processors to interpret the wager from the data signals and to cause the recording of a digital representation of the wager in one or more storage devices;

using at least one of the processors to cause one or more display devices to display the basic game in a first thematic state of the plurality of possible thematic states;

using at least one of the processors to initiate the secondary event in response to a triggering event in the basic game;

using at least one of the processors to cause at least one of the display devices to display the secondary event in a second thematic state of the plurality of possible thematic states; and using at least one of the processors to, upon concluding the secondary event, cause at least one of the display devices to display the basic game in the second thematic state.

9. The method of conducting a wagering game of claim 8, wherein the interface device is selected from a group consisting essentially of a touch screen, a mouse, a joy stick, a switch, and a microphone.

10. The method of conducting a wagering game of claim 8, wherein the electronic data signals are selected from a group consisting essentially of an electrical current, an electrical voltage, an electrical charge, an optical signal, an optical element, a magnetic signal, and a magnetic element.

11. The method of conducting a wagering game of claim 8, wherein the one or more processors include a plurality of processors, and the one or more storage devices include a plurality of storage devices.

12. The method of conducting a wagering game of claim 8 wherein the plurality of possible thematic states include a past-era theme, a present-era theme, and a future-era theme.

13. The method of conducting a wagering game of claim 8 wherein the basic game includes a plurality of reels.

14. The method of conducting a wagering game of claim 8, wherein each of the thematic states is associated with a different type of secondary event having different game-play rules.

15. The method of conducting a wagering game of claim 8 wherein the secondary event includes a plurality of sequential segments having different thematic states of the plurality of possible thematic states, the second thematic state being the thematic state of a last of the sequential segments.

16. The method of conducting a wagering game of claim 11, wherein at least two of the processors are located in separate enclosures from one another, and wherein the gaming apparatus further comprises a network communication link establishing operable communication between the processors in the separate enclosures.

17. A method of conducting a wagering game for a human player, the wagering game including a game sequence in which a player makes a wager and a wagering game outcome is determined, the wagering game including a plurality of possible thematic states, the method comprising the acts of:

conducting the wagering game using a gaming apparatus to receive inputs from the player and to generate wagering game outcomes that are communicated to the player, the gaming apparatus comprising, a user interface device configured to receive an input from the player, one or more display devices configured to display information or graphics to be viewed by the player, one or more storage devices, and one or more processors configured to execute computer instructions relating to the wagering game; and accepting, at the user interface device, a player input and transforming the player input into electronic data signals indicative of a wager to play the wagering game;

using at least one of the gaming apparatus processors to interpret the wager from the data signals and to, at least in part, cause the recording of a digital representation of the wager in at least one of the gaming apparatus storage devices;

using at least one of the gaming apparatus processors to cause at least one of the display devices to display a basic portion of the wagering game in a first thematic state of the plurality of possible thematic states;

using at least one of the gaming apparatus processors to cause at least one of the display devices to display a secondary event in a second thematic state of the plurality of possible thematic states; and using at least one of the gaming apparatus processors to, upon concluding the secondary event, cause at least one of the display devices to display the basic portion of the wagering game in the second thematic state.

18. The method of conducting a wagering game of claim 17, wherein the one or more processors include a plurality of processors, and the one or more storage devices include a plurality of storage devices.

19. The method of conducting a wagering game of claim 17, further comprising displaying the basic portion of the wagering game in the second thematic state until a second secondary event in a thematic state other than the second thematic state is triggered.

20. The method of conducting a wagering game of claim 17 wherein the secondary event includes a plurality of sequential segments having different thematic states of the plurality of possible thematic states, the second thematic state being the thematic state of a last of the sequential segments.

21. A computer readable storage medium memory encoded with instructions for directing a gaming system to perform the method of claim 17.

22. The method of conducting a wagering game of claim 18, wherein at least two of the processors are located in separate enclosures from one another, and wherein the gaming apparatus further comprises a network communication link establishing operable communication between the processors in the separate enclosures.

* * * * *